US005692563A

United States Patent [19]

Krueger et al.

[11] Patent Number: 5,692,563

[45] Date of Patent: Dec. 2, 1997

[54] TUBING FRICTION REDUCER

[75] Inventors: R. Ernst Krueger, Newport Beach; N. Bruce Moore, Costa Mesa, both of Calif.

[73] Assignee: Western Well Tool, Inc., Houston, Tex.

[21] Appl. No.: 713,024

[22] Filed: Sep. 12, 1996

[51] Int. Cl.[6] ..... E21B 17/10

[52] U.S. Cl. ..... 166/85.5; 166/241.6; 175/325.6; 175/325.7; 175/76

[58] Field of Search ..... 175/73–76, 325.1, 175/325.3, 325.5–325.7; 166/77.2, 85.5, 241.1, 241.6

[56] References Cited

U.S. PATENT DOCUMENTS

| | | | |
|---|---|---|---|
| 1,877,395 | 9/1932 | Goeser | 175/325.3 |
| 1,913,365 | 6/1933 | Bailey | 175/325.3 |
| 2,248,160 | 7/1941 | Crawford | 175/325.3 |
| 2,718,266 | 9/1955 | Berry et al. | 166/241.6 |
| 3,044,554 | 7/1962 | Kluck | 166/241.6 |
| 3,361,493 | 1/1968 | Melton | 175/325.3 |
| 4,875,524 | 10/1989 | Bradley et al. | 166/241.6 |
| 4,974,691 | 12/1990 | Leaney et al. | 175/325.3 |
| 5,522,467 | 6/1996 | Stevens et al. | 175/73 |

OTHER PUBLICATIONS

Dawson, R and Paslay, P. R., Drillpipe Buckling in Inclined Holes, JPT, pp. 1734–1738, Oct. 1984.

He, X., and Age, K., Helical Buckling and Lock-up Conditions for Coiled Tubing in Curved Wells, Tech. Paper SPE-25370, 1993.

*Primary Examiner*—Roger J. Schoeppel

*Attorney, Agent, or Firm*—Christie, Parker & Hale, LLP

[57] ABSTRACT

A tubing friction reducer is mounted on a length of tubing within a bore hole. The friction reducer includes a cylindrical body having a first section and a second section hingedly secured around an exterior surface of the coiled tubing, the cylindrical body having an outside diameter larger than an outside diameter of the coiled tubing and less than an inside diameter of an adjacent bore surface. A plurality of roller bearings positioned on and extending outwardly from the cylindrical body extending in a generally axial direction along the cylindrical body for the purpose of reducing friction between the coiled tubing and the bore surface generated upon contact between the coiled tubing and the bore surface. Retaining mechanisms such as collapsible springs are included for securing the roller bearings to the cylindrical body. The tubing friction reducers are placed along the tubing at intervals to either minimize injector force, prevent buckling, and tubing failure, due to buckling or wear.

20 Claims, 13 Drawing Sheets

TUBING FRICTION REDUCER

CROSS-REFERENCE TO RELATED APPLICATION

This application claims priority from U.S. Provisional Application Ser. No. 60/004,374 filed Sep. 27, 1995.

FIELD OF THE INVENTION

This invention relates generally to coiled tubing friction reducers, and more particularly to a type of coiled tubing friction reducer (CTFR) that works to decrease the friction normally experienced by the coiled tubing when same tubing, is run in a bore hole, together with a recommended method for the placement of said friction reducers on the coiled tubing.

BACKGROUND OF THE INVENTION

Coiled tubing is used in a variety of oil well operations including drilling, stimulation, completions and recompletions, horizontal well servicing, fishing, high pressure applications, well profile modification, plug and abandonments, and remedial activities. For each of these various types of operations coiled tubing offers the benefits of speed, reduced costs, and reduced environmental impact. For example, coiled tubing drilling rigs present smaller footprints, lower visual impacts, lower noise levels, and reduced cuttings disposal problems while allowing positive pressure control, lower costs of operation, faster trips, and underbalanced drilling which is beneficial from a formation damage aspect. Additional benefits follow during operations involving stimulation in that coiled tubing operations allow the accurate placement of acids, lower treatment volumes while providing protection to the production tubulars from acid exposure. Similarly coiled tubing is useful for completions in the placement of inhibitors to control or eliminate scale, paraffin, and salt. For horizontal well servicing, coiled tubing can convey or deploy well services such as electric line tools, memory tools, downhole videos, casing packers, matrix stimulators, cementing tools and lost circulation material. Coiled tubing can be used in fishing operations to remove stuck wireline, electric line tools, and flow control devices. In high pressure applications, coiled tubing can be used to clean-out fill from high pressure wells (over 5000 psi) including frac-sand, hydrate plugs, asphaltene, paraffin or sand plugs with the use of high-pressure jets or solvent. Profile modification of water shut-off, encroachment control of water coning, and break-through into the oil reservoir with the use of microfine cement are other operations that can involve the use of coiled tubing operations. In addition, many other uses of coiled tubing are currently being developed for oil field and other applications.

For many of these operations such as stimulation, completions, horizontal well servicing, remedial activities and drilling, coiled tubing may be inserted into wells with rapidly curving profiles and horizontal bore holes. A current major limitation to these activities is associated with coiled tubing "buckling" and the additional wall friction forces that are generated by said buckling. Buckling occurs when the axial forces required to produce movement of the coiled tubing within a well bore exceed a critical level due to the effects of frictional forces that accompany such movement, the coiled tubing then begins buckling first into a sinusoidal shape and, if the compressive forces continue to increase will subsequently deform the coiled tubing further into a helical shape. Both the sinusoidal and helical forms of buckling add to the frictional forces resisting movement and thus can eventually lead to the cessation of coiled tubing operation.

The force required to push coiled tubing into a well increases rapidly once helical buckling occurs. The frictional drag then increases until it finally overcomes the insertion forces resulting in a condition known as "lock-up" and the eventual failure of the tube itself.

From a practical coiled tubing operations viewpoint, it is highly desirable to avoid the buckling and eventual failure of the coiled tubing for failure of the coiled tubing prevents the completion of the planned activity and often times necessitates an effort to extract said tubing from the well bore. The financial impact of such an extraction can therefore be significant. Two types of failures frequently occur. First, the frictional wall contact forces brought about by sinusoidal and then followed by helical buckling become so great that the coiled tubing becomes "locked up" and will no longer move despite the amount of additional force applied to the end of the tubing. Second, the coiled tubing, in many instances of buckling, plastically becomes deformed or failed from the resulting compounding of stresses related to bending, axial thrust, and pressurization.

The force required for buckling is dependent upon the mode of failure. Typically, sinusoidal buckling requires the least force, frequently occurring near the top of the hole in the vertical section of the bore. Helical buckling requires still greater force before initiation and as such helical buckling usually begins near the bottom of the hole. The mode of buckling is affected by the configuration of the well bore; specifically, the three dimensional well bore curvature strongly affects the expected failure mode and the associated forces at failure.

Typical well configurations consist of a vertical cased section and a directional or horizontal section. The well bore frequently has steel casing that has a substantially greater diameter than the coiled tubing. For wells with high curvature, the typical failure mode begins with sinusoidal buckling in the vertical section followed by helical buckling in the horizontal section. As discussed, helical buckling can result in lock-up or failed coiled tubing.

Another relatively common problem associated with coiled tubing operations is differential sticking. Differential sticking occurs when the pressure of the formation is less than of the bore hole. Operational equipment such as coiled tubing lying on the bottom of the bore hole has a tendency to therefore be "pressured" into the formation. When this occurs over relatively long lengths, the result is that the coiled tubing becomes stuck to the bore hole wall. The resulting inability to move said coiled tubing under these conditions of differential sticking then requires remedial action to free the same which can result in increased operational costs. The objective in coiled tubing operations then seems to be one where friction (in the forms of buckling and "sticking") can be reduced to a point where operations can continue to be conducted.

The most effective methods to be used in increasing the resistance to buckling of a tube in boreholes include increasing the effective diameter of the tubing, increasing the effective thickness of the coiled tubing, and reducing the friction between the coiled tubing and the bore hole wall. The invention described herein, provides all three of the methods as will be discussed below.

SUMMARY OF THE INVENTION

This invention provides a coiled tubing friction reducer which when used reduces the friction and torsion developed when the coiled tubing is run within a bore hole, thereby extending the distance the coiled tubing can be run within said bore hole together with the useful life of the coiled tubing that can be expected by preventing and reducing the normal wear that can be expected to take place on same.

The device herein described is specifically designed to assist in the prevention of both sinusoidal and helical buckling. This invention also serves to centralize the coiled tubing in the vertical section of the bore holes, hence acting to increase the buckling resistance of said coiled tubing. In the horizontal section of the holes this invention also acts to centralize the coiled tubing and reduce the sliding friction between both the coiled tubing and the bores wall while also inhibiting pipe twist. This invention is therefore applicable to all portions of the coiled tubing string within a bore. The benefits to be achieved through the use of this tool together with the placement method proposed for the use of the CTFR's are reduced proclivity for "lock-up" together with the preventing of early tubing failure.

In one embodiment, the invention comprises a coiled tubing friction reducer assembly which includes a cylindrical body secured to the exterior of the coiled tubing itself. Multiple axial rows of ball bearing rollers are located along the length of the cylindrical body.

The cylindrical body consists of two halves and is equipped with a hinge and an open section. The open section runs along the axial length of the friction reducer parallel to the ball bearings. The open section provides an area for makeup screws to secure the two halves together. The friction reducer is opened along the hinges and installed onto the coiled tubing and secured thereto by the makeup screws.

The ball bearings extend outwardly away from the surface of the body of the friction reducer, thereby separating the coiled tubing from the bore hole walls, while preventing the coiled tubing from becoming stuck to the formation because of pressure differences between the bore hole and the formation. Similarly, because the coiled tubing is maintained a distance from the casing or the bore walls, settling debris on the coiled tubing does not result in further "sticking" of the pipe to the formation. Because the ball bearings allow the rolling of the coiled tubing instead of sliding over the formation or the casing, the coefficient of friction between these two surfaces is reduced (from about 0.3 to about 0.05), which results in less injector force required to insert the coiled tubing string into the hole while at the same time extending the distance that the coiled tubing can be run in the well bore. To be able to reduce the wear on the surface of the coiled tubing would also be a significant advantage in that most coiled tubing is relatively thin, having a wall thickness ranging between about 0.15 and 0.2 inches. Such wear on the coiled tubing is known to reduce the useful life and can result in premature failures. Furthermore, by reducing the friction associated with the movement of coiled tubing wall thicknesses within the coiled tubings wall thicknesses can remain uniform thus reducing further the tendency to "buckle."

Another important feature accomplished by the present invention is that the friction reducer can be installed on the coiled tubing while said tubing is in operation with very little interruption in the usage process. The friction reducer is simply opened at the hinges, placed around the coiled tubing, and securely fastened in place by the makeup screws. The friction reducer is also sufficiently small and flexible to allow coiling onto the coiled tubing reel, which in that same eliminates the need to install and remove the friction reducers after each usage.

In other embodiments of the present invention, the friction reducer includes circumferential rows of ball bearings located on the body of the friction reducer. The number of balls is redundant for use in highly rigorous applications to allow for damage to individual ball bearings, or uneven load distribution on the friction reducer. The balls are held in place by recesses drilled in the inside diameter of the cylindrical body. Similarly, the balls extend beyond the body of the device to provide a roller bearing surface. The cylindrical body is divided into two parts separated by an opening and are hinged together.

In yet another embodiment of the present invention, the friction reducer includes ball bearings held above the surface of a cylindrical housing by expandable cages. The ball bearings are held above the surface of the cylindrical body by collapsible springs. The springs are connected to the cylindrical body so that the ends of the springs are free to slide and allows the cages to collapse when encountering a restriction in the bore hole during use. The cylindrical body has specially shaped grooves to allow for the springs to collapse. The cylindrical body similarly consists of two halves separated by an opening and hinged together. The advantage of this embodiment is that the friction reducer can pass through small restrictions yet can expand to a predetermined diameter, typically the diameter of the bore hole and hold the coiled tubing centralized within the bore. By holding the coiled tubing in the center of the bore hole, the tendency for buckling of the tubing through friction and torque is reduced. Other embodiments of the invention are also disclosed herein.

In all embodiments the CTFR reduces sliding friction that is associated with the movement of the coiled tubing hence decreasing the tendency for buckling which then acts to increase the length of the coiled tubing that can be run in the hole. The friction reducer also serves as a stiffener for the coiled tubing which serves to delay the initiation of buckling, thereby increasing the length of the tubing that can be run in the bore hole.

One of the serious limitations associated with the running of coiled tubing in well bore has to do with the added wall friction forces generated during buckling, particularly those forces associated with "helical buckling." When axial compressive forces exceed a critical value for the tubing (or wire line), the coiled tubing will buckle. The mode of buckling will start as a sinusoidal wave shape and as the compressive forces increase the mode changes further into a helical shape. As the coiled tubing is confined to the well bore, the tubing (while buckling) comes in contact with the wall of the well bore which results in additional contact forces. As means exist today to predict the initiation of buckling, it is contemplated that the method of placement (location and frequency of installation) of the friction reducers on the coiled tubing are also claimed in the invention.

Such placement of coiled tubing friction reducers would take into account the analysis of the tubing string as it exists within the well bore, the applied forces, the combined loads, the design performance characteristics of the coiled tubing friction reducer and other applicable criteria.

The application method of placement of coiled tubing friction reducers is an essential part of the process involving control of buckling and friction reduction within economic constraints. As with the use of any tool and method of use, there is an economic cost associated with same that must be justified relative to the benefits. Hence, the optimum use of coiled tubing friction reducers requires the determination of the minimum number of coiled tubing friction reducers to achieve the desired results. Excessive placement of coiled tubing friction reducers results in increased costs with diminishing benefits.

These and other aspects of the invention will be more fully understood by referring to the following detailed descriptions and accompanying drawings.

DETAILED DESCRIPTION

Figure 1:
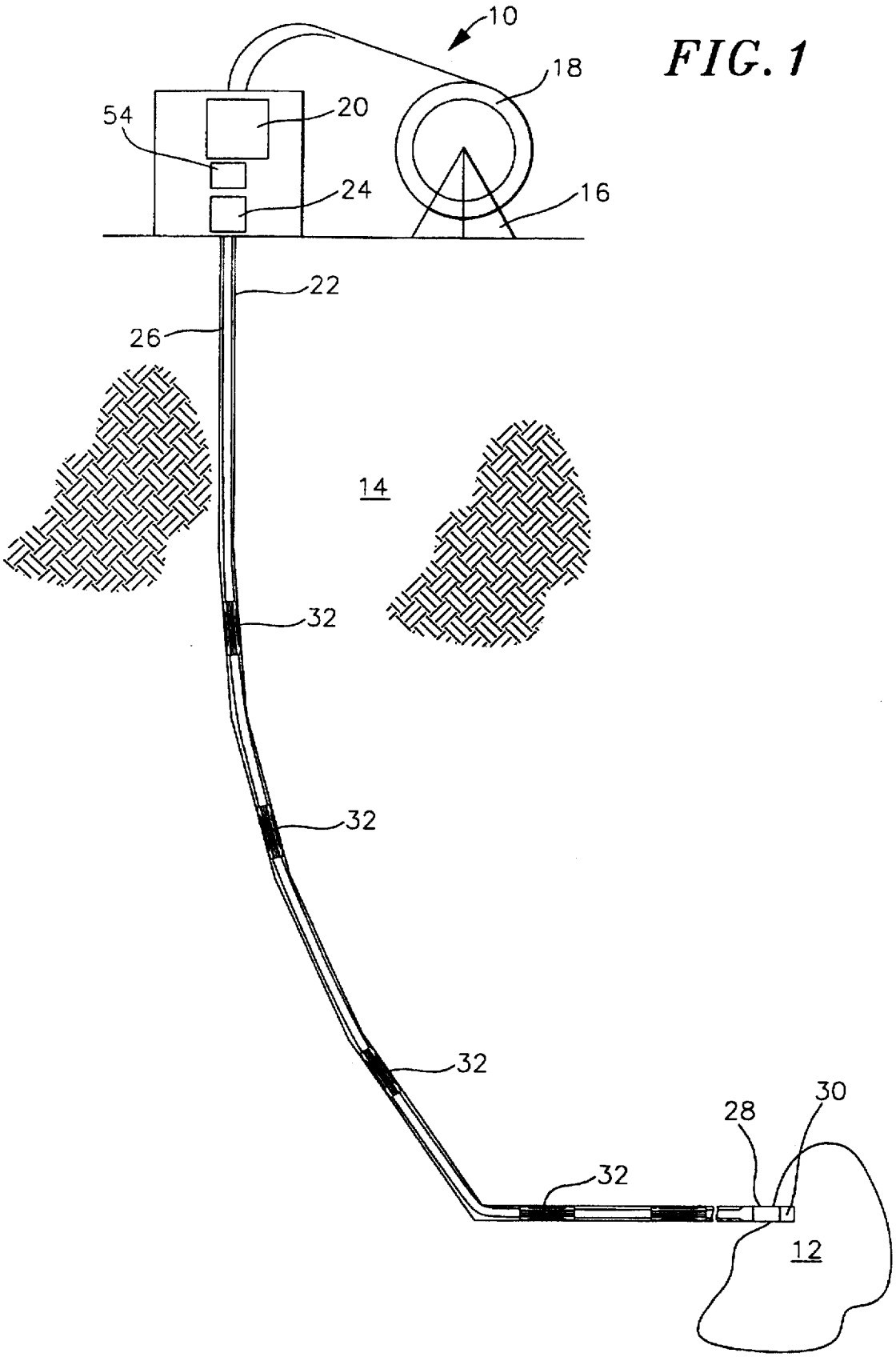
FIG. 1 is a schematic vertical cross-sectional illustration of a coiled tubing drilling assembly.

FIG. 1 illustrates a coiled tubing drilling assembly 10 for drilling/servicing directional and horizontal wells 12 in an underground formation 14. It is to be understood that although the invention is explained by way of example in drilling operations, the invention is equally applicable to other coiled tubing, pipe, rod, and wireline and other applications that require reductions in friction together with prevention of buckling and wear during operations as previously discussed, involving components having a large length over diameter ratio. The coiled tubing assembly includes a reel 16 for discharging a coiled tubing 18. An injector 20 forces the coiled tubing into the well bore 22 through a blow-out preventer stack 24. Typical sizes of bore holes for coiled tubing drilling are less than six inches in diameter and commonly are three and three-fourths inches. An elongated cylindrical casing 26 may be cemented in the well bore to support the formation around the bore. The invention is described with respect to its use inside casings or tubing in a well bore, but the invention can also be used in coiled tubing operations conducted within a bore that does not have a casing. Therefore, in the description of the claims to follow, where reference is made to contact with the wall or inside diameter of a casing, the description also applies to contact with the wall of a well bore; and where reference is made to contact with a bore, the bore can be the wall of a well bore or the inside diameter of a casing.

Located at the end of the coiled tubing drill string is a bottom hole assembly 28 which includes a drill bit 30. Separate longitudinally spaced apart coiled tubing friction reducers 32 are mounted along the length of the drill string to protect the drill string from damage that can occur when running/pulling the coiled tubing inside the casing. The friction reducers 32 are designed to reduce the friction between the coiled tubing and the casing or well bore when they come in contact.

Figure 2:
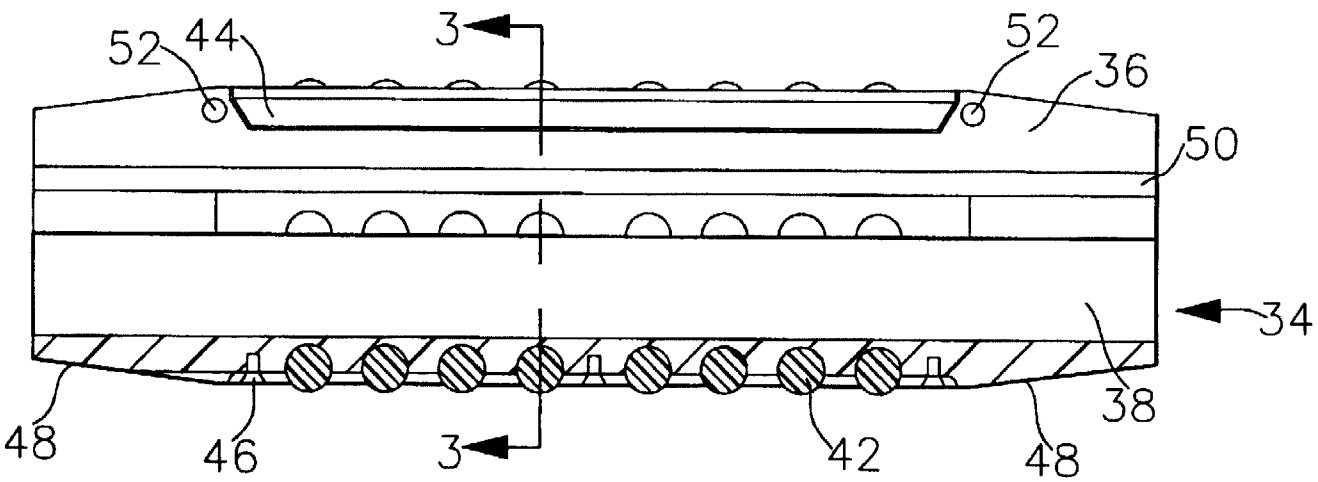
FIG. 2 is a side view, partly in cross-section, illustrating a coiled tubing friction reducer according to the principles of this invention.
Figure 3:
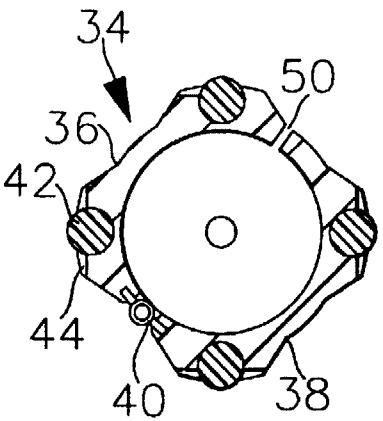
FIG. 3 is a cross-sectional view, taken along line 3—3 of FIG. 2.

FIGS. 2 and 3 illustrate a first embodiment of the coiled tubing friction reducer 32 of the present invention. The coiled tubing friction reducer includes a cylindrical body 34 consisting of a first section 36 and a second section 38. The sections are movably connected to each other by hinges 40. Multiple rows of ball bearing rollers 42 are located along the axial length of the cylindrical body. Preferably the number of rows of ball bearing rollers in this embodiment is four, however that number can vary depending upon such variables as the distance between the protectors on the coiled tubing string, the diameter of the coiled tubing, the inside diameter of the bore, etc. Similarly, the length of the row and the number of ball bearings in the row can be varied according to the same variables. Preferably, there are eight ball bearings evenly spaced on each of the four rows. By way of example, for a two-inch diameter coiled tubing, the outside diameter configuration of the friction reducer is 3.03 inches, and the length is approximately 11.3 inches. The ball bearings are 0.2188 inches in diameter but other sizes can be used, resulting in either a larger or smaller overall diameter of the friction reducer.

The ball bearing rollers can be retained on the cylindrical body by a retaining strip 44 which is fastened to the cylindrical body by screws 46. The ball bearing rollers can be replaced by removing the retaining strip. The balls can also be installed and replaced through drilled holes in the inside diameter of the cylindrical body.

Both ends of cylindrical body 44 are tapered 48 to allow for easy passage through the blow-out preventer stack 24 (FIG. 1) or any other well control devices (not shown) and to prevent stress concentrations which might effect the tubing to which the friction reducer is installed. An open section 50 is located in the cylindrical body and runs along the thinner section of the cylindrical body parallel to the ball bearings and then diagonally toward the thicker section of the body collinear with the ball bearings. This deviation in the location of the opening allows sufficient material to be available at the location of the makeup screws 52 for securing the first and second section of the cylindrical body together around the coiled tubing. The coiled tubing friction reducer can be made from metal such as aluminum, plastic, rubber, or other composites depending upon the particular drilling operation. In one embodiment, the cylindrical body is made of urethane, having teflon ball bearings and an aluminum retaining strip. The makeup screws are steel and a thread locking device (not shown) can also be incorporated into the body of the friction reducer.

One of the primary advantages of coiled tubing drilling operations is that drilling can be accomplished at relatively high speeds. Consequently, the friction reducer has been designed for very rapid installation and can be installed anywhere above the blow-out preventer stack 24. Typically, the coiled tubing friction reducer is installed through an access door 54 (see FIG. 1) located after the injector 20. Installation is quickly accomplished by opening the cylindrical body at the hinge 40, placing the friction reducer around the coiled tubing and tightening the makeup screws 52. A friction reducer generally can be installed in less than 15 seconds.

During use, the coiled tubing will come into contact with the interior surface of the casing or well bore. The ball bearing rollers allow the rolling of the coiled tubing within the casing or well bore, reducing the previously discussed sliding friction created between the coiled tubing and the casing or well bore.

Figure 2A:
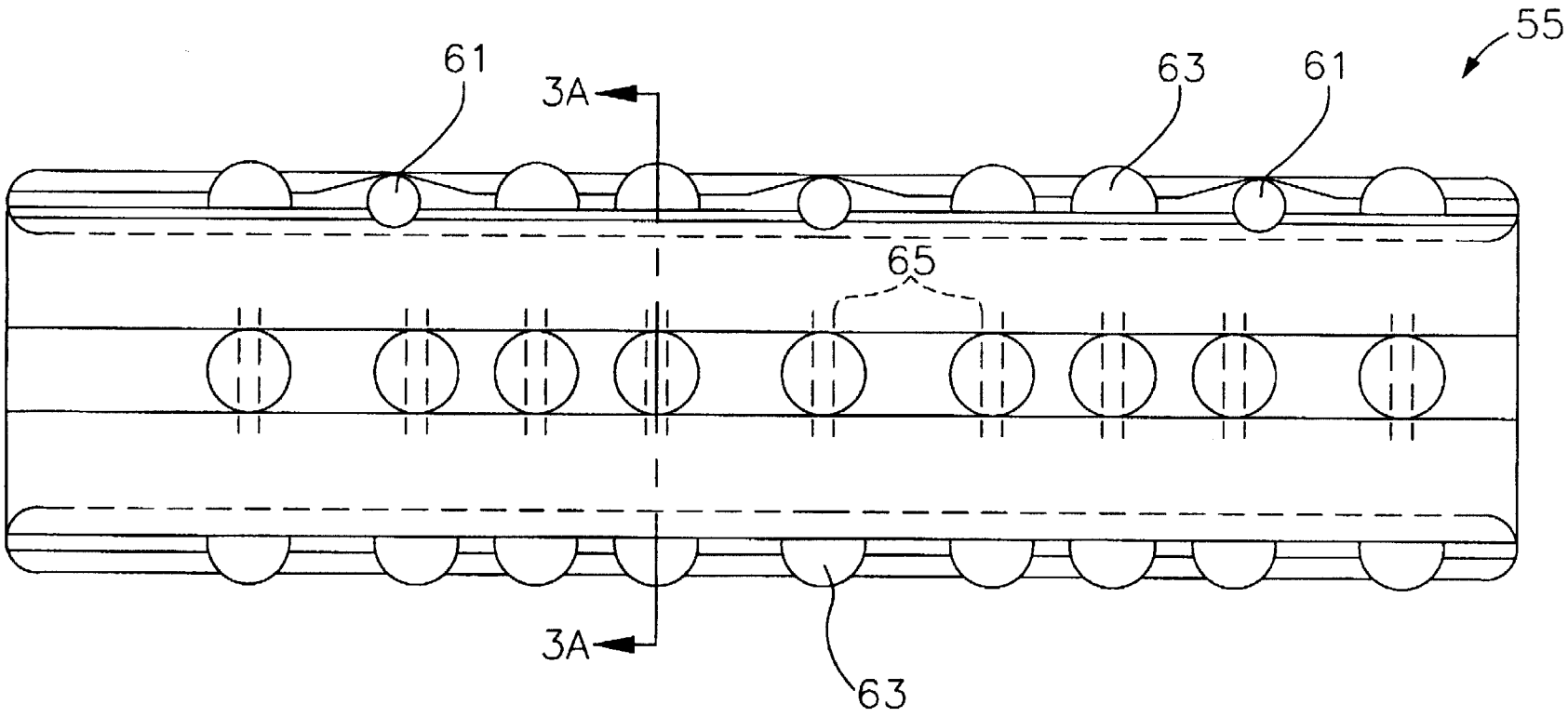
FIG. 2*a* is a side view of a first alternative embodiment of the coiled tubing friction reducer of FIG. 1.
Figure 3A:
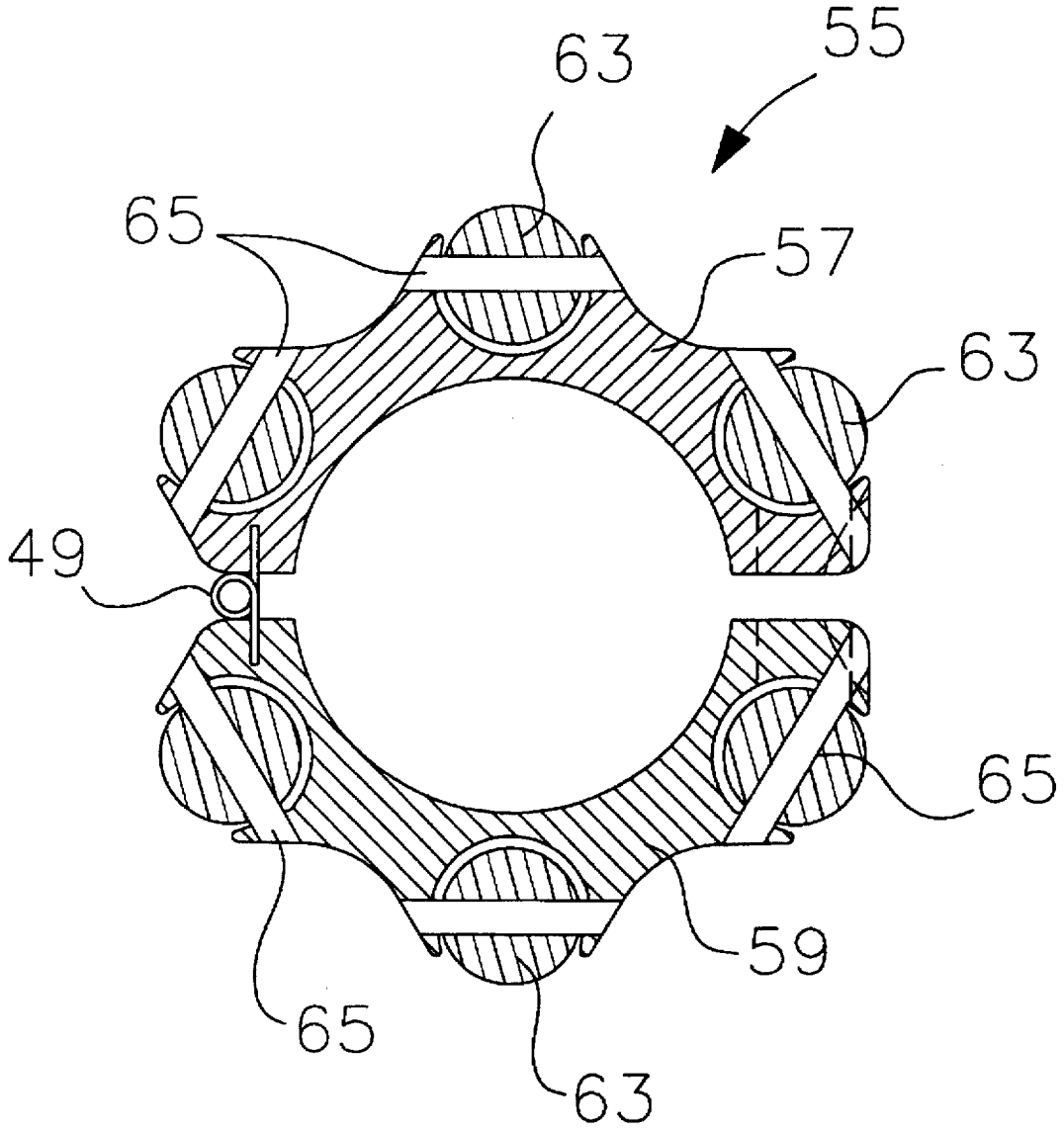
FIG. 3*a* is a cross-sectional view, taken along line 3*a*—3*a* of FIG. 2*a;*

FIGS. 2*a* and 3*a* illustrate an alternative embodiment coiled tubing friction reducer 55. Friction reducer 55 also includes a cylindrical body consisting of a first section 57 and a second section 59 hinged together by hinge 49. The first and second section includes a location for make-up screws 61 to rigidly secure the first section and second section around the coiled tubing. In this embodiment, the ball bearings 63 are rigidly connected to the cylindrical body by axles 65. Six rows of ball bearings are illustrated, however, the number of rows can vary depending upon the particular application.

Figure 4:
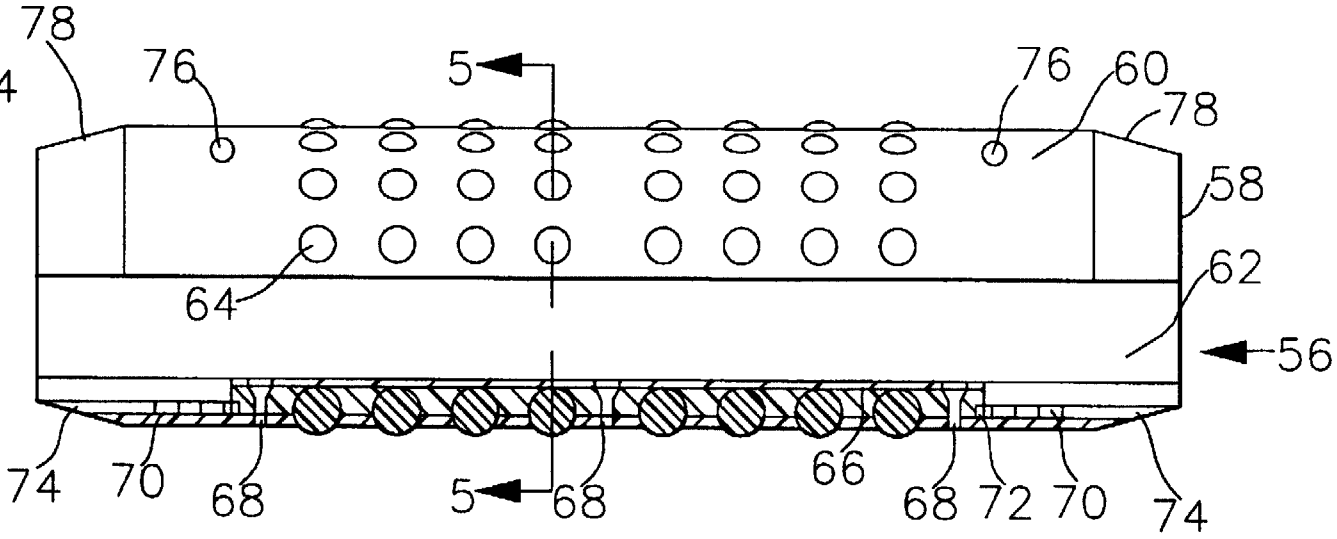
FIG. 4 is a side view, partly in cross-section, of a second alternative embodiment of the coiled tubing friction reducer of FIG. 1.
Figure 5:
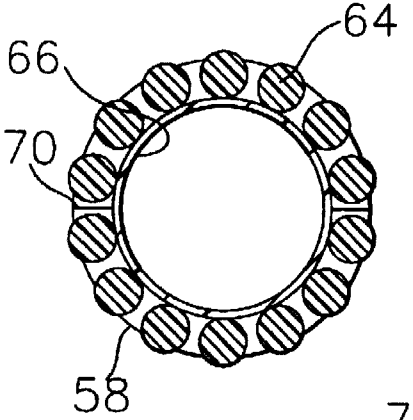
FIG. 5 is a cross-sectional view taken along 5—5 of FIG. 4.

FIGS. 4 and 5 illustrate a second alternative embodiment coiled tubing friction reducer 56. Friction reducer 56 also includes a cylindrical body 58 consisting of a first section 60 and a second section 62. The overall dimensions of friction reducer 56 will vary for different sized coiled tubing, but by way of example, for a two inch outer diameter coiled tubing, the friction reducer would have an inner diameter of two inches, an outer diameter of 3.03 inches and a length of approximately 11.3 inches.

The primary difference between friction reducer 56 and friction reducer 32 is the arrangement of the ball bearing rollers 64. Preferably, the ball bearing rollers consist of eight rows of 14 balls circumferentially spaced around the perimeter of the outer body totaling 112 balls. It is to be understood that the number of balls is adjustable for specific loads and other well bore parameters.

The number of ball bearings is specifically redundant in this design to allow for damage to a number of ball bearings without having to replace the entire friction reducer. This design is particularly useful in very rigorous drilling applications. The ball bearings are held in place by a race 66 that is attached to the interior surface of the cylindrical body by screws 68. The race holds the ball bearing rollers such that the balls extend through and beyond the outer diameter of the cylindrical body to provide a roller bearing surface. The preferred design has a ball bearing diameter of 0.2188 inch, but other sizes can be used, resulting in either larger or smaller overall diameter dimensions of the friction reducer.

The race 66 can be removed to replace damaged ball bearings and is divided into two parts, similar to the cylindrical body with half of the race being secured to each of the first and second sections 60, 62. The race holds the ball bearing rollers in place against the cylindrical body and is intended to be installed after the ball bearings are loaded into each of the first and second sections. The race can be made of a molded material that can include friction increasing materials such as sand screen or rubber. By including sand screen or rubber, the coefficient of friction between the friction reducer and the coiled tubing is increased, thus decreasing the probability of the friction reducer slipping on the coiled tubing string. Also, rubber and/or sandscreen can be used together with a groove on the inner diameter of the friction reducer to allow fitting of the friction reducer to small variations in coil tubing outer diameters.

The first and second sections of the cylindrical body are connected by hinges 70 having an extended hinge pin 72 which extends into the inner race to assist in holding the inner race in place. The cylindrical body 58 includes slots or holes 74 for installation of the hinge pins. The hinges open to approximately 150 degrees to allow for easy installation of the friction reducer on the coiled tubing. Once installed on the cylindrical tubing, the first and second sections of the cylindrical body are held in a closed position by makeup screws 76. Both ends of the cylindrical body include tapers 78 to allow easy passage through the blow-out preventer or other well bore restrictions. The tapered angle is adjustable for particular blow-out preventer restrictions or other well parameters. Friction reducer 56 is installed on the coil tubing in a similar method as that discussed with respect to friction reducer 34. Friction reducer 56 can be made of aluminum, plastic, composites, rubber, or combinations of these materials and preferably includes a urethane cylindrical body, connected by steel hinges and makeup screws, with the roller ball bearings made of teflon.

Figure 6:
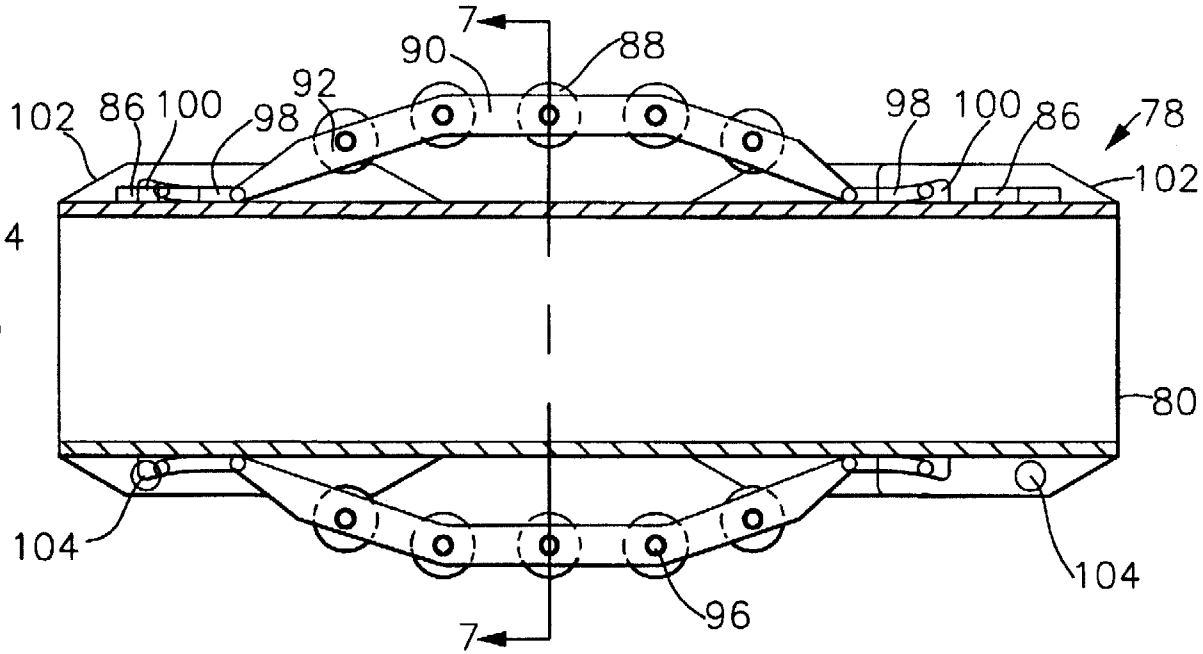
FIG. 6 is a cross-sectional side view of a third alternative embodiment of the coiled tubing friction reducer of FIG. 1, shown in the expanded position.
Figure 7:
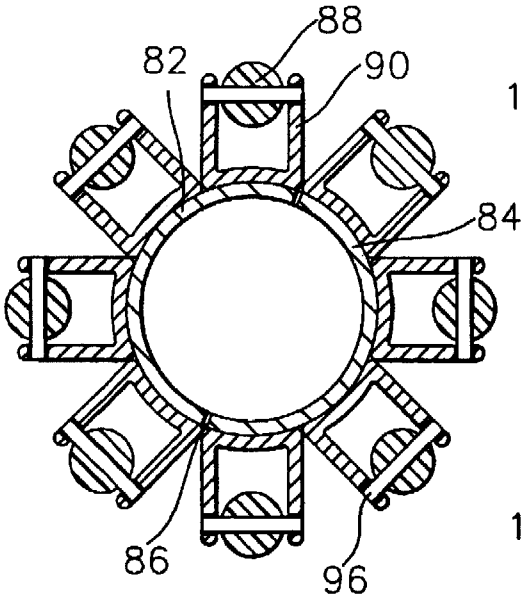
FIG. 7 is a cross-sectional view taken along line 7—7 of FIG. 6.

FIGS. 6 and 7 illustrate a third and preferable alternative embodiment coil tubing friction reducer 78. Coiled tubing friction reducer 78 is expandable and includes a cylindrical body 80 divided into a first section 82 and a second section 84. The first and second sections are rigidly held together by hinges 86 which are molded into or mechanically fastened to the cylindrical body.

Ball bearing rollers 88 are positioned above the outer surface of the cylindrical body by collapsible springs 92. An expandable cage 90 for housing the ball bearings is located along the length of spring 92. Alternatively, the springs may be molded onto the cylindrical body. Collapsible springs 92 have a thickness and width that vary along its length so that the springs can collapse under loading during deployment into the well bore and during passage through restrictions such as the blow-out preventer and other hole restrictions.

The ball bearing rollers are held within the expandable cages 90 by a roller shaft 96 passing through the center of the ball bearings. The roller shaft connects the two sides of the cage 92 thus increasing the cage's overall structural strength and resistance to bending from side loads. The tolerance between the roller shaft 96 and a hole through the ball bearings is sufficiently large to tolerate drilling debris without inhibiting the rolling of the ball bearings.

Spring 92 has curved ends 98 which are free to slide along the axial length of the cylindrical body. The cylindrical body has grooves 100 which provide a capture area for the curved ends and allows the spring to collapse under loading. The curved ends also act as a hook to prevent the spring from leaving the grooves. The grooves prevent lateral movement of the springs as they are loaded and reduce lateral movement of the friction reducer as the springs collapse. This feature prevents twisting of the springs that could result in snagging of the friction reducer in the casing or well bore. The cylindrical body similarly contains tapers 102 located at either end of the body to allow easy passage through blow-out preventers and other well control devices. The taper angle is adjustable for particular blow-out preventer restrictions or other well parameters.

Hinges 86 allow the friction reducer to be opened approximately 100 degrees to allow for installation on the coiled tubing. Friction reducer 78 includes makeup screws 104 for tightening the friction reducer on the coiled tubing. Expandable friction reducer 78 is installed in a fashion similar to friction reducers 34 and 56.

Friction reducer 78 utilizes ball bearings as rolling elements, but alternatively, other configurations such as rollers, cylinders, hour-glass shaped cylinders, and other variations are also acceptable as rolling elements. The number of balls is determined by the overall load carried by the friction reducer but preferably includes five (5) balls per spring for a total of 40 ball bearings. Size variation including length, inside diameter, and outside diameter are adjustable to fit the outside diameter of the coiled tubing, however by way of example, friction reducer 78 includes 0.5 inch diameter ball bearing in an overall length of 8.69 inches. Its collapse diameter is 3.129 inches and its expanded outer diameter is 3.976 inches.

Preferably, coiled tubing friction reducer 78 can support a coiled tubing weight of 200 pounds, which is equivalent to approximately 100 feet of coiled tubing depending on buckling software predictions. Expandable coiled tubing friction reducer 78 typically is placed at 10 to 50 foot intervals along the coiled tubing. The method of placement will be described in more detail herein.

An advantage of the design of expandable coil friction reducer 78 is that the friction reducer can collapse to allow its passage through restrictions such as blow-out preventers, yet it can expand to a predetermined diameter (typically the diameter of the well bore) to hold the coiled tubing centralized within the hole. By centralizing the coiled tubing within the well bore the friction is ultimately reduced through delaying the initiation of buckling. With the addition of rollers to this type of CTFR, buckling is further delayed through the reduction in sliding coefficient of friction.

In addition, more of the coiled tubing can be suspended and supported by varying the diameter of the springs, as well as varying the spring constant thus reducing the amount of coiled tubing that comes into contact with the well bore. The tubing being thus centralized also uses the springs to react against the forces tending to bring about buckling, either sinusoidal or helical, to significantly forestall the condition known as "lock-up" of the tubing.

Figure 8:
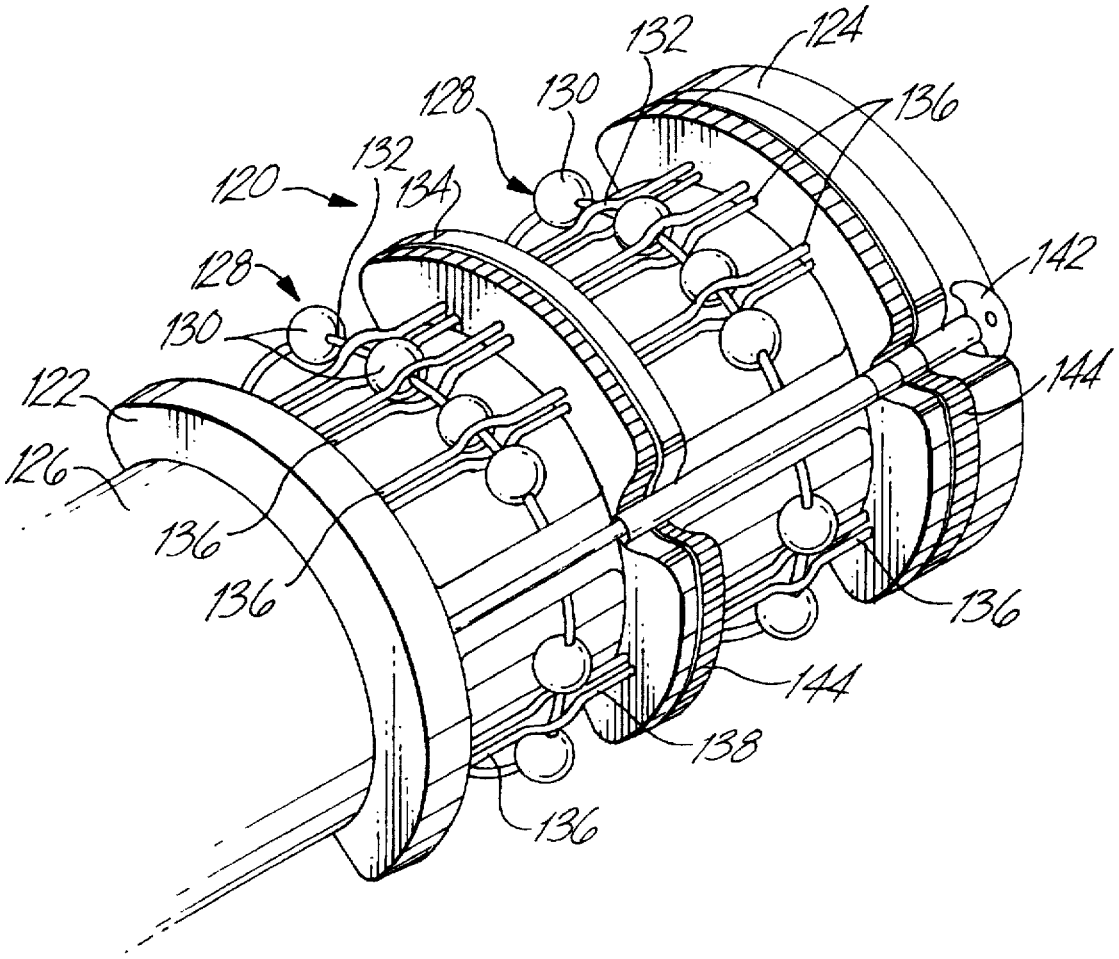
FIG. 8 is a perspective view of a fourth alternative embodiment of the coiled tubing friction reducer of FIG. 1.
Figure 9:
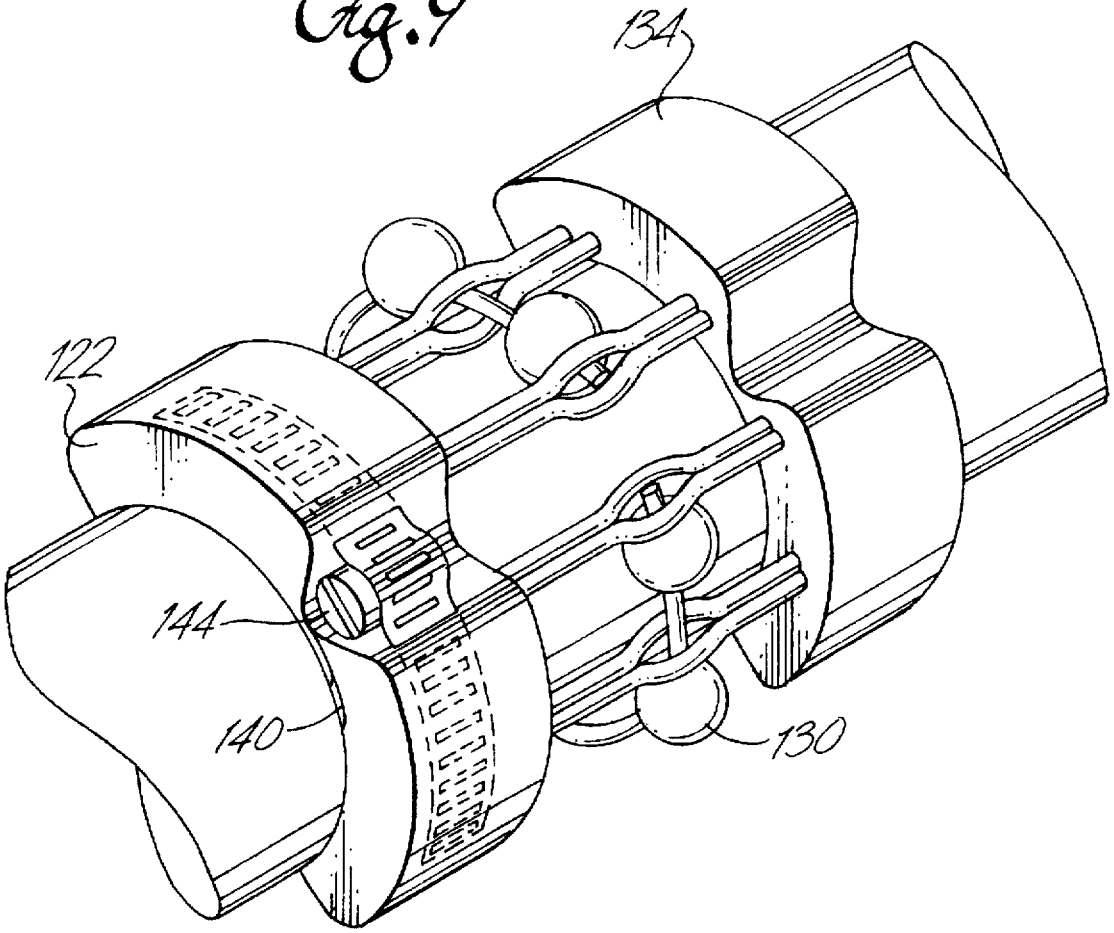
FIG. 9 is a detail perspective view of the friction reducer of FIG. 8.

FIGS. 8 and 9 illustrate a fourth alternative embodiment for the coil tubing friction reducer. Friction reducer 120 includes rubber moldings 122 and 124 located at either end of the friction reducer. Moldings 122 and 124 extend around the exterior surface of the coiled tubing 126. A plurality of circumferential rows 128 of Teflon ball bearings extend around the exterior of the coiled tubing. Each row 128 consists of a plurality of Teflon ball bearings 130 connected to one another by a steel wire ring 132 passing through the center of each ball bearing. Each row of ball bearings is separated axially by an intermediate rubber molding 134. Each row of ball bearings is held in a vertical position by a steel retaining line 136 terminating and secured within rubber moldings 122 and 124. These steel retaining lines include a curved portion 138 which either bends over or under the steel retaining ring 132. Retaining line 136 similarly passes entirely through intermediate rubber molding 134. Rubber moldings 122, 124 and 134 consists of two halves separated by an opening 140 and are hinged together by pin 142. The friction reducer is securely fastened to the coiled tubing by hose clamps 144 extending around the circumference of each rubber molding.

Figure 10:
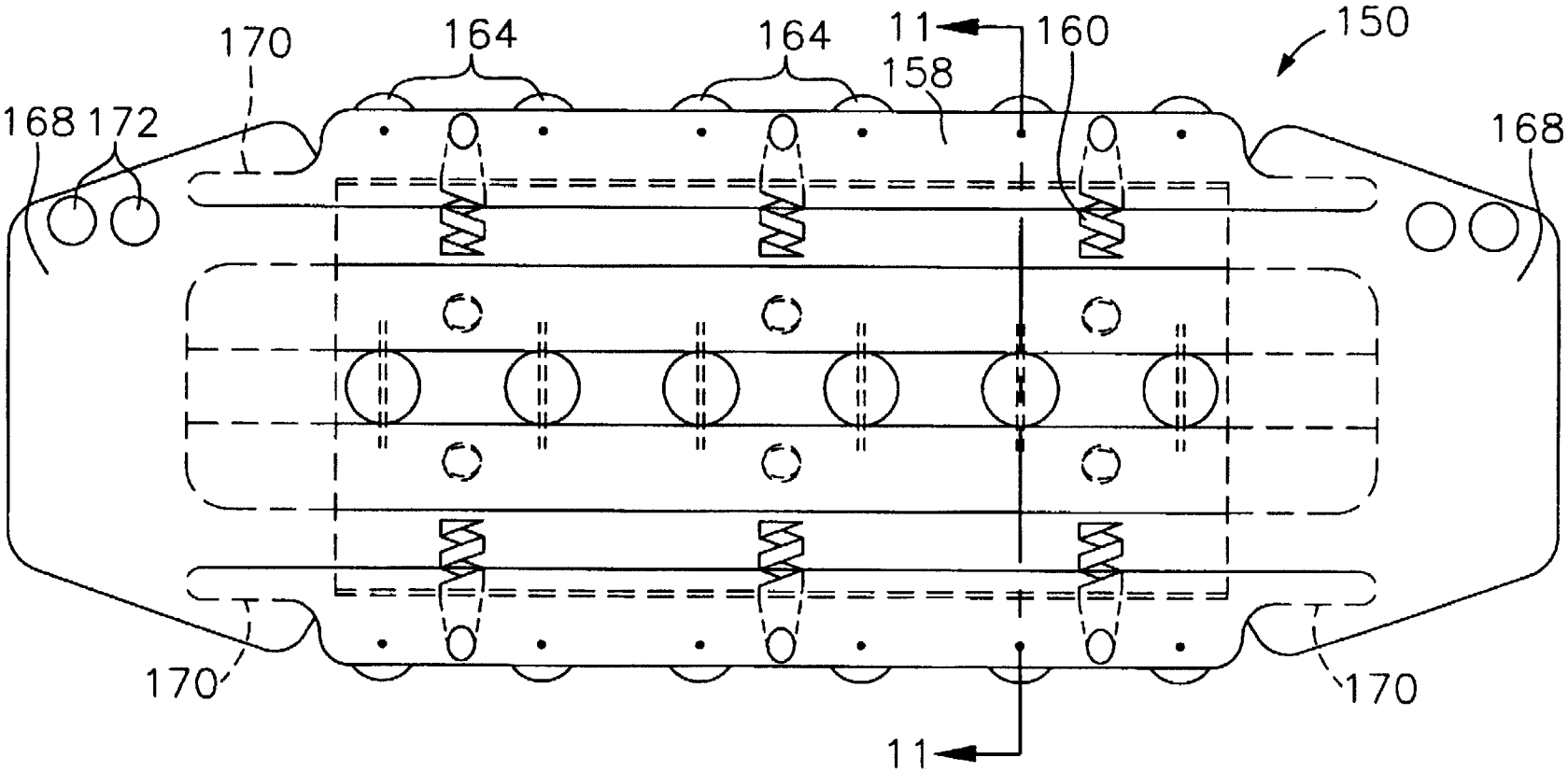
FIG. 10 is a side view of a fifth alternative embodiment of the friction reducer of FIG. 1.
Figure 11:
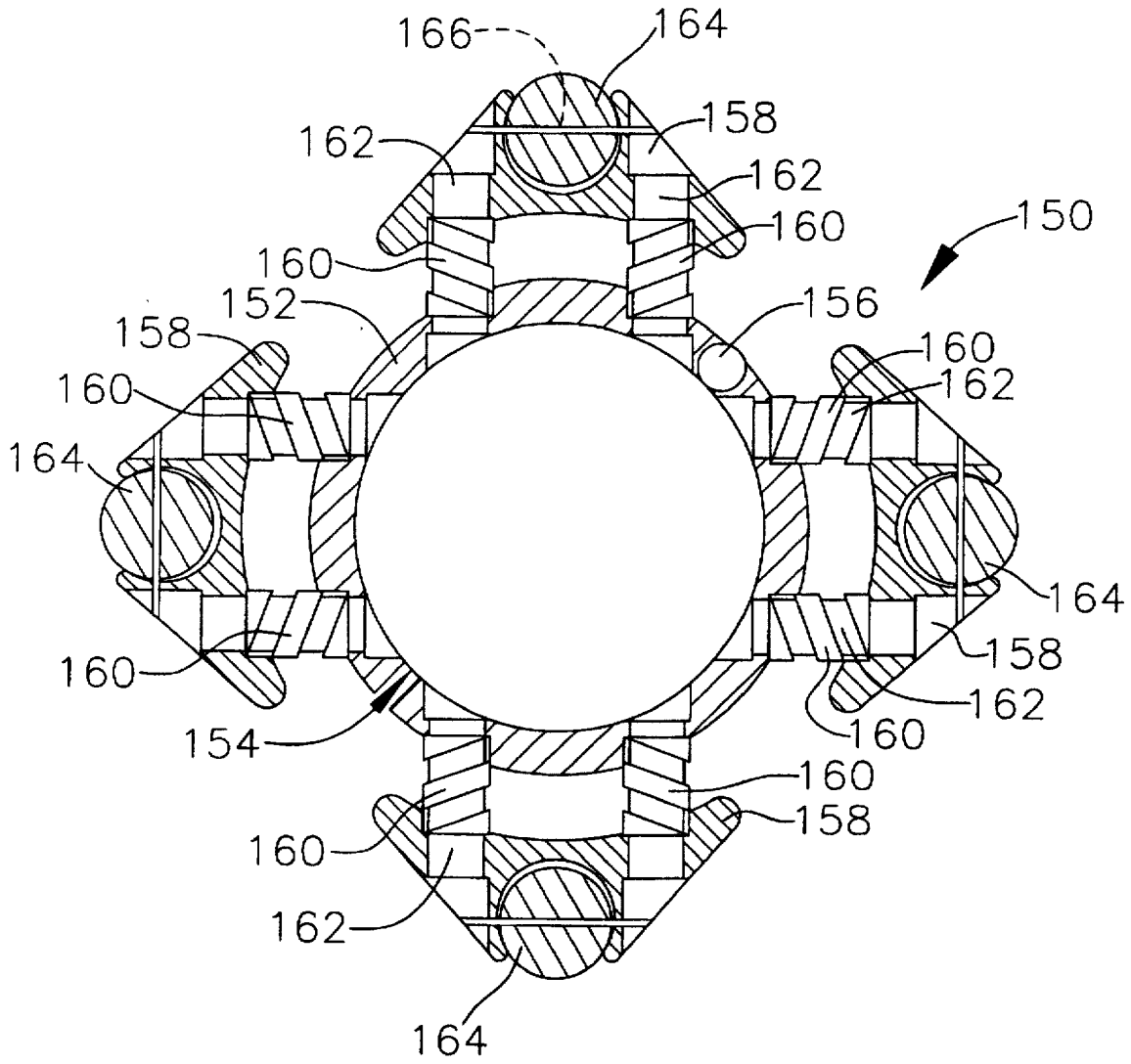
FIG. 11 is a cross-sectional view, taken along line 11—11 of FIG. 10.

A fifth embodiment is illustrated in FIGS. 10 and 11. An expandable coiled tubing friction reducer 150 includes a cylindrical inner housing 152 consisting of two halves having an opening 154 and hinged together by hinge 156. Inner housing 152 is placed around the outer surface of the coiled tubing. Extending from the inner housing are a plurality of outer housings 158, which preferably consists of three or more separate sections. The outer housing is supported above the inner housing by coiled springs 160 and pin assembly 162. Coiled springs 160 are positioned around pin assembly 162 and contained by washers at both ends.

A plurality of ball bearings 164 are positioned along the length of the outer housing and are rigidly attached to the outer housing and rotate on an axle 166. The number of ball bearings utilized can vary depending upon the overall load to be carried by the expandable friction reducer. The friction reducer is fixed in an axial direction along the coiled tubing by a containment collar 168 positioned at either end of the friction reducer which overlaps a reduced portion 170 of the outer housing. The containment collars consist of two halves hinged together and held securely to the coiled tubing by makeup screws 172. By way of example, the expandable coiled tubing friction reducer 150 has an inner diameter of 1.75 inches, an outer diameter of 4 inches having ball bearing 0.50 inches in diameter with a total length of approximately 11 inches. The friction reducer can be made from a variety of materials including aluminum, rubber and composites.

During operation as the friction reducer 150 encounters a bore hole restriction each section of the outer housing may collapse or expand independent of the other sections. The outer housing sections are urged to an expanded position by the coil springs in order to centralize the coil tubing within the bore hole. The outer diameter of the friction reducer in a collapsed position would be approximately 3.5 inches for the dimensions previously listed.

Figure 12:
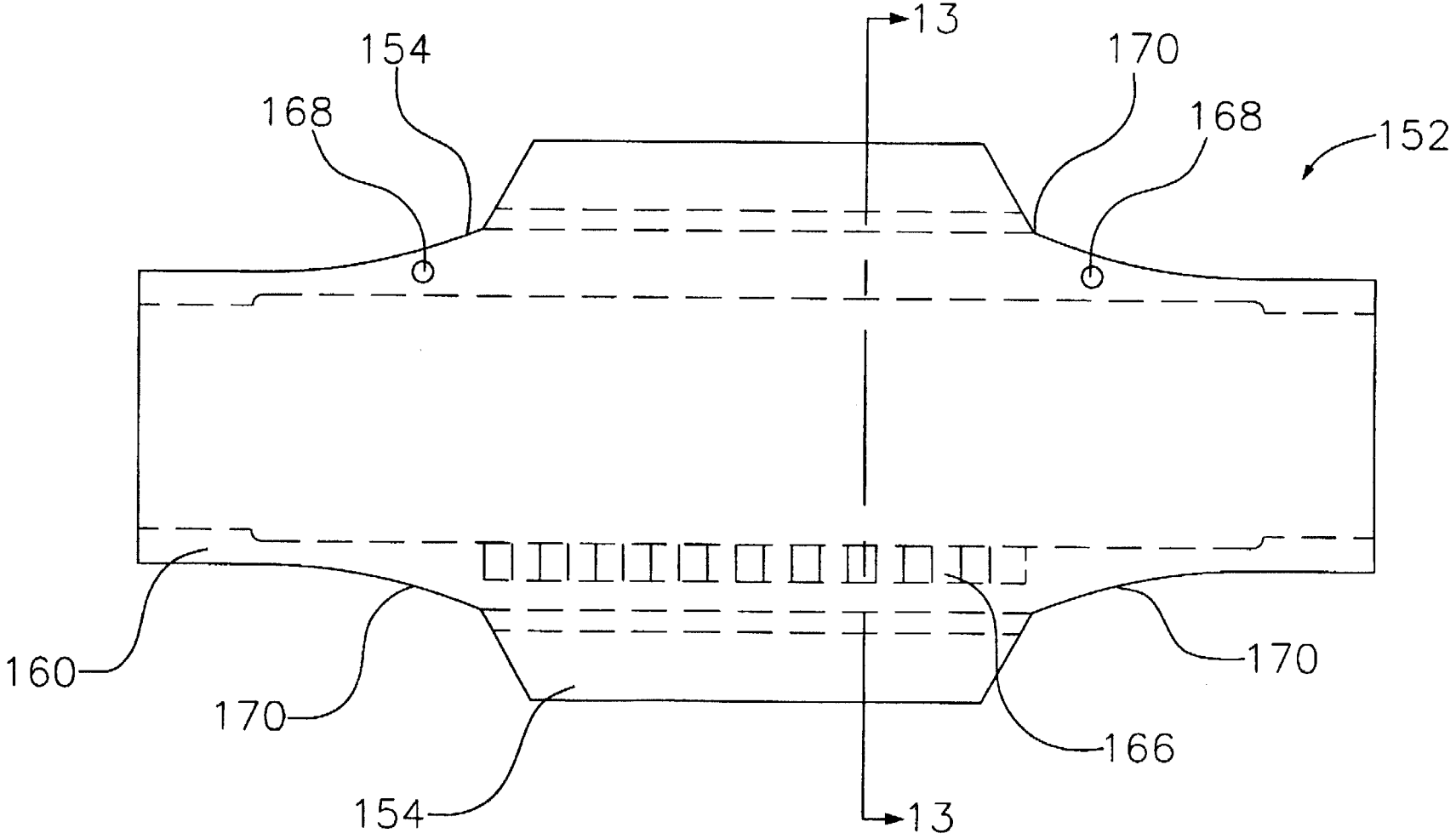
FIG. 12 is a side view of a sixth alternative embodiment of the friction reducer of FIG. 1.
Figure 13:
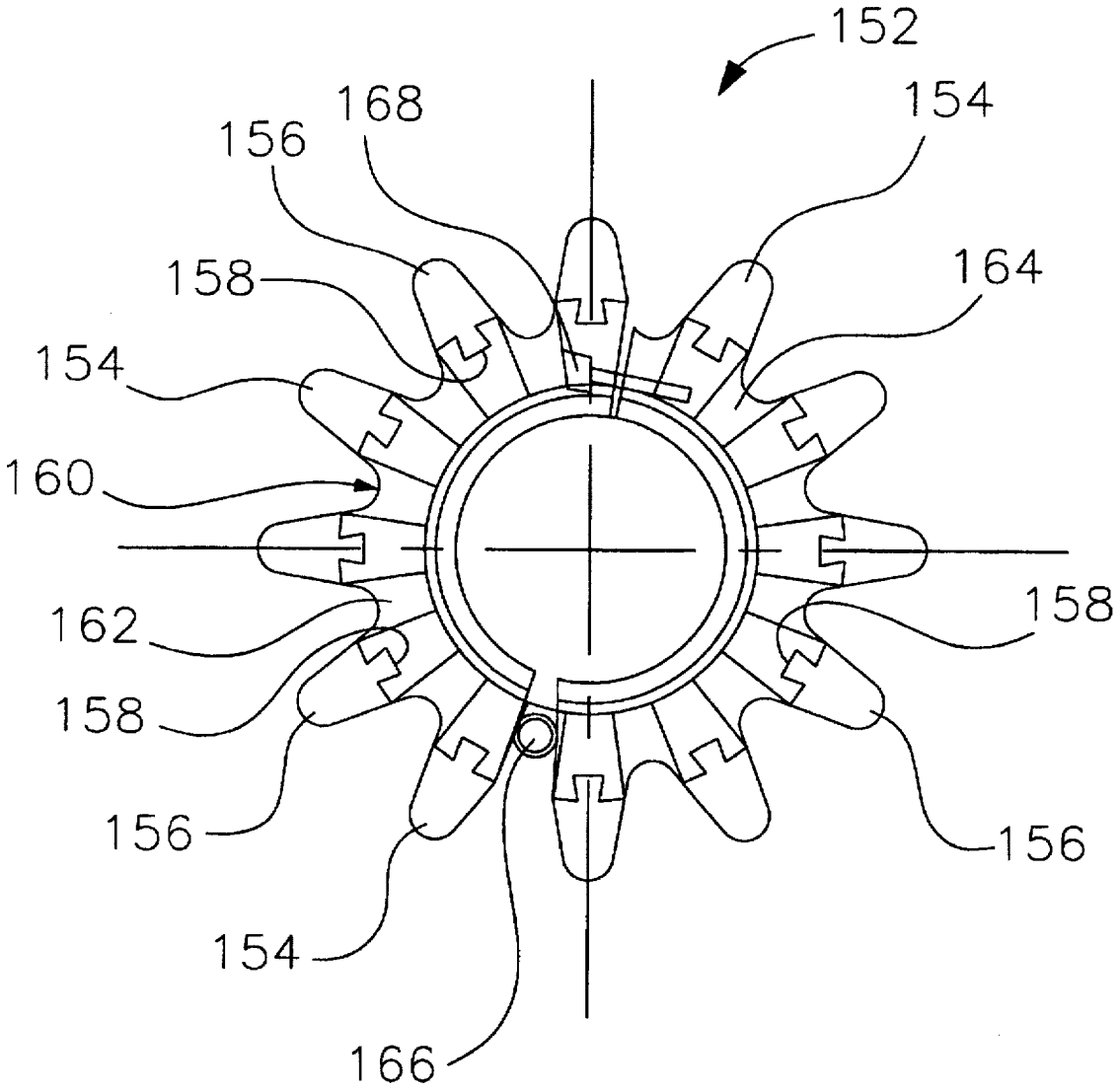
FIG. 13 is a cross-sectional view, taken along line 13—13 of FIG. 12.

For bore holes that reduce in diameter with depth, an expandable type coiled friction reducer is recommended. However, a fixed diameter coiled tubing friction reducer is the design of preference at the top of the build section of the bore hole. A fixed diameter type coiled tubing friction reducer 152 is illustrated in FIGS. 12 and 13. Friction reducer 152 provides greater structural strength for centralization of the coiled tubing in the bore hole. Centralization is advantageous in that greater loads and energy are required before initiation of helical buckling. Friction reducer 152 is approximately cylindrical with a multiplicity of blade-like projections 154. The number of projections would be dictated by the amount of side force expected on the coiled tubing and the desired increase in local rigidity of the coiled tubing. The design illustrated in FIGS. 12 and 13 has twelve projections, but any number from 3 to 30 is possible. The tips 156 of the projections are made from low friction materials such as a graphite Teflon plastic. The tips are inserted into a dovetail shaped groove 158 in the cylindrical body 160. The tips are held in the dovetail shaped groove with an interference fit, thus securing the tips when in use and allowing replacement when desired.

The body 160 of the friction reducer 152 can be made from a variety of materials, but typically are comprised of aluminum. Thickness of the aluminum body at the point of attachment to the coiled tubing would be determined to minimize stress discontinuities and hence prevent local crimping with associated coil tubing buckling. Other materials for body 160 can include rubber for extreme flexibility and steel for rigidity. The optimum balance of flexibility vs. rigidity would depend on hole geometry and loads. The central body 160 is comprised of two approximately symmetrical halves 162 and 164 attached on one side with a hinge 166 and on the opposite side by retaining bolts 168.

In a preferred configuration, projections 154 would not extend the entire length of the cylindrical body 160 as shown in FIG. 12. In this design the cylindrical body includes a tapered portion 170 transitioning from the projections towards the coiled tubing to minimize the size of the "footprint" of the friction reducer on the coiled tubing. This is especially important when trying to minimize the stress concentrations resulting from installation. Alternatively, the friction reducer may include the blade like projections along its entire length of the cylindrical body for applications requiring maximum rigidity. Friction reducer 152 would be installed in a similar fashion to that discussed with previous embodiments.

An alternative configuration that increases axial flexibility is a variation of FIGS. 12 and 13. The blade-like projections can be oriented circumferentially. The regions between the blades can be made substantially thinner than the blades, increasing axial flexibility of the coiled tubing friction reducer. Similarly, blades can have other orientations such as a spiral relative to axial or circumferential axes of the tool.

Typical coiled tubing operations involve substantial change in direction as a function of hole depth that must be included in determination of tubing buckling. As shown in FIG. 1, tubing can change in orientation by more than 90 degrees, changing from vertical at the surface to horizontal at the bottom of the hole. The industry standard methods of defining position within a bore hole is by defining depth, inclination, and azimuth.

As the coiled tubing is inserted into the hole and encounters changes in inclination and azimuth, contact loads on the coiled tubing increase. This generalized method of determination of contact loads on the coiled tubing therefore must include the generalized position definition.

Several analytical methods have been suggested for the prediction of helical buckling and lock-up such as, for example, in R. Dawson and P. R. Paslay, "Drillpipe Buckling in Inclined Holes," JPT, pp. 1734–1738, Oct. 1984, and X. He and K. Age, "Helical Buckling and Lock-up Conditions for Coiled Tubing in Curved Wells," SPE 25370, 1993. These influences are incorporated herein by reference. Analytical methods to predict buckling and lock-up typically consider geometry, force, and material variables associated with the combined loading on the coiled tubing. The following lists typical input parameters.

- Hole depth, inclination and azimuth angles as well as inclination and azimuthal build rates.
- Coiled tubing outside diameter, inside diameter, cross sectional area, moment of inertia, Young's modulus, weight (per unit length), and yield strength.
- Mud weight and resulting buoyancy factor.
- Coefficients of friction of steel to steel (coiled tubing dragging on casing), steel to formation (coiled tubing dragging on open hole wall), coiled tubing friction reducer to steel (coiled tubing friction reducer contacting casing) and coiled tubing friction reducer to formation (coiled tubing friction reducer on open hole).
- Coiled tubing friction reducer effects of localized stiffening upon coiled tubing (increased flexural rigidity of coiled tubing at location of coiled tubing friction reducer).
- Coiled tubing friction reducer effects of localized centralization of coiled tubing in the bore holes (effects of reduction of eccentricity of coiled tubing within the bore hole thus increasing the resistance to buckling).
- Injection force (from injector head).
- Pulling force (from use of a downhole tractor).

These parameters are combined using force equilibrium equation to determine the tubing contact forces as a function of length along the coiled tubing.

A general form for representing the contact loads as a function of location along the length of the tubing is as follows:

$$\text{Equation (1)}\quad F(s)=F_I+F_T+F_g-F_f$$

where:

F(s)=Force per unit length at end of the tubing $F_I$=Force at the injector

FT=Force from tractor (Downhole tractors are devices that can directionally pull the coiled tubing within the hole. Downhole tractors are used to extend the length of coiled tubing that can be inserted into a horizontal hole. For example, typical current practices limit the horizontal section of coiled tubing to less than 2000 feet, but with downhole tractors the horizontal length can be increased to beyond 5000 feet). The sign convention used is that down the hole is a positive tractor force and up the hole is negative.

$F_g$=Gravitational force on pipe adjusted for buoyancy $F_f$=Contact frictional forces The contact frictional forces have a coefficient of friction that is negative for pick-up operations and positive for slack-off operations. From equation 1 the contact forces, lock-up forces, buckling forces, together with the buckling pitch length can be determined. Stresses in the coiled tubing can be determined by using well-known conventional equations which can be combined and evaluated via well-known failure criterion. From the use of Equation (1) and the result of the combined stress state, the criteria for the placement of coiled tubing friction reducers can be applied.

Criteria for Coiled Tubing Friction Reducer Placement

Figure 14:
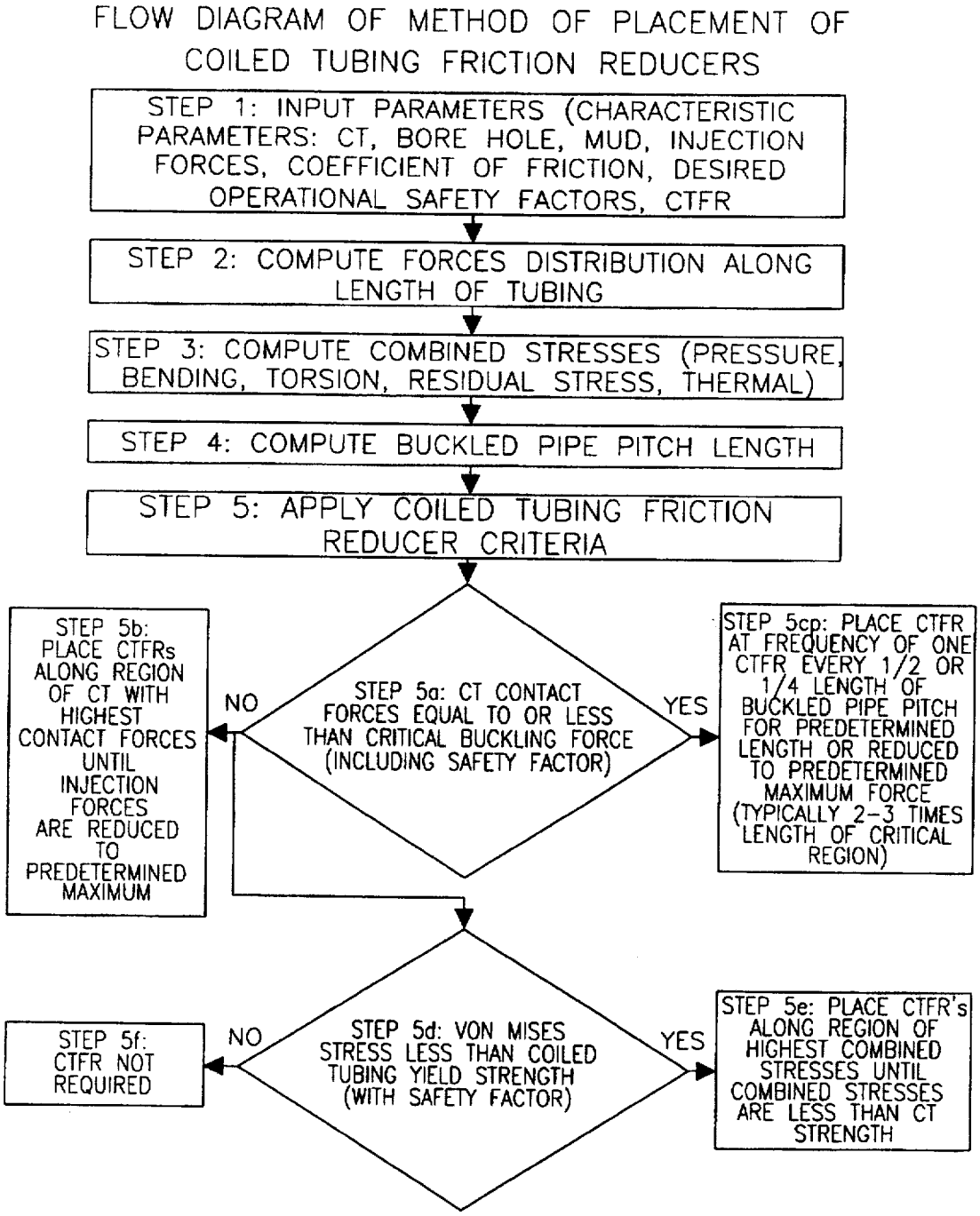
FIG. 14 is a flow diagram of the method of placement of the coiled tubing friction reducers.

Using the analytical methods as previously described the criteria are applied to determine the placement and frequency of the coiled tubing friction reducer on the coiled tubing. FIG. 14 shows the flow diagram of the method of placement of coiled tubing friction reducers. The steps for the placement of coiled tubing friction reducers are as follows:

Step 1

Input Significant Parameters

This includes (but not limited to) characteristics of the tubing such as diameter, thickness, material yield strength, operational safety factors, fatigue characteristics. Another group of parameters describe the bore hole including depth, inclination, and azimuth. Mud characteristics are also important including mud weight and type (oil based or water based). The forces imposed on the pipe by the injector head and related factors are included. The performance characteristics of the coiled tubing friction reducer such as resulting coefficient of friction, effective resistance to twist (torque), stiffness increase of coiled tubing with the coiled tubing friction reducer are also to be considered. In addition, performance safety factors will be defined.

Step 2

Force Distribution Calculation

With the input parameters defined, the force distribution along the length of the coiled tubing will be determined as a function of location.

Step 3

Calculation of Combined Stresses

The stresses in the coiled tubing will be computed considering the applicable pressure forces, the bending forces, the torsional forces, the residual stresses in the coiled tubing, thermal stresses (if applicable).

Step 4

Buckled Pipe Pitch Length

The pitch length of the buckled pipe (if it buckles) is determined.

Step 5

Apply Coiled Tubing Friction Reducer Use Criteria

The application of the use criteria of the coiled tubing friction reducer involves several sub-steps listed below.

Step 5a

Comparison of Contact Forces to Buckling Force

With the contact forces determined and the buckling force determined at every point along the tubing, the two forces are then compared. The comparison results in a branch of the method. If the contact forces with an associated safety factor are less than the buckling force at the location, then the Step 5b is applied.

Step 5b

Placement of Coiled Tubing Friction Reducer to Minimize Injection Force

Application of this criterion is to place coiled tubing friction reducers along the length of the coiled tubing over the region with highest contact forces. Sufficient coiled tubing friction reducers must be applied in order to reduce the injection force (as measured at the surface) to a predetermined point. The set point is typically determined by acceptable working capacity of the coiled tubing injector.

Step 5c

Placement of Coiled Tubing Friction Reducer to Prevent Buckling

If the contact force is equal to or greater than the buckling force, coiled tubing friction reducers are placed at the interval of ½ to ¼ the pitch length of the buckled pipe along the coiled tubing. Coiled tubing friction reducers are placed over the region predicted to buckle as well as approximately the same interval on either side of the buckled region for an effective coverage area of 2–3 times the length of the buckled region. As a modification of this criterion, the predicted buckled region can be covered along with additional regions until the predetermined maximum injection force (with safety factor) is achieved.

Step 5d

Yielding of Tubing

If the contact stresses do not exceed the critical buckling stresses but the combined stresses based on a Von Mises (maximum-distortion energy) criterion exceed the yield stress, the tubing will fail. (Other acceptable combined stress-strain criterion include maximum-stress, maximum-shear, and maximum-strain-energy). To prevent the tubing failure, the criterion is applied to place coiled tubing friction reducers along the region of highest stress in the tubing in sufficient quantity that the stress is less than the yield stress (including appropriate predetermined safety factor).

Step 5e

Coiled Tubing Friction Reducers Not Required

If the contact stresses are less than the critical buckling stress, the tubing will not buckle, and if the combined stresses are less than the yield stress via a Von Mises criterion and the injection forces are less than a predetermined point, the criterion would suggest that coiled tubing friction reducers are not required.

Thus the combined logic of the application of the criteria defined above provides a complete set of uses for the coiled tubing friction reducer; significantly other criteria that do not include all of the above applications are reduced subsets of this general application, providing less than optimum placement for all conditions.

These and other aspects of the invention can also be understood in the following claims.

In these claims, the word "tubing" should also refer to any rod, wireline, pipe, or other body having large length over diameter ratios to the point where "buckling" requires consideration.

What is claimed is:

1. A friction reducing apparatus for a tubing assembly having a large length over diameter ratio comprising:

a cylindrical body secured around an exterior surface of the tubing, the cylindrical body having an outside diameter larger than an outside diameter of the tubing;

a plurality of roller beatings extending outwardly from and in a generally axial direction along the cylindrical body for reducing friction between the tubing and an adjacent contacting surface; and means for securing the bearing means to the cylindrical body.

2. The friction reducer of claim 1 wherein the cylindrical body comprises a first section and a hingedly connected second section.

3. The friction reducer of claim 1 wherein the cylindrical body includes a plurality of axially spaced sections, each section rigidly connected to an adjacent section.

4. The friction reducer of claim 1 wherein the roller bearings are ball bearings.

5. The friction reducer of claim 4 wherein the ball bearings are arranged in a plurality of axially spaced rows along an outside surface of the cylindrical body.

6. The friction reducer of claim 4 wherein the ball bearings are arranged in a plurality of circumferentially spaced rows along an outer surface of the cylindrical body.

7. The friction reducer of claim 4 wherein the means for attaching the ball bearings is a plurality of collapsible springs.

8. The friction reducer of claim 7 wherein the collapsible springs have a first end slidably retained by the cylindrical body and a second end slidably retained by the cylindrical body.

9. The friction reducer of claim 8 wherein the cylindrical body includes grooves for slidable engagement of the first and second ends of the collapsible springs, said grooves preventing lateral movement of the spring.

10. A friction reducing apparatus for a tubing assembly having a large length over diameter ratio comprising:

a cylindrical housing secured around an exterior surface of the tubing, the housing having an outside diameter larger than an outside diameter of the tubing;

a plurality of blades extending outwardly from the housing along the entire length of the blade for reducing friction between the tubing and an adjacent surface; and means for securing the blades to the housing.

11. The friction reducer of claim 10 wherein the means for securing the blades are a plurality of dovetail slots along the length of the cylindrical body.

12. A tubing friction reducer adapted for mounting on a tubing pipe inside a bore in an underground formation or in a tubular casing installed in the formation, the tubing having an outside diameter normally spaced from an inside wall surface of the bore or casing, the friction reducer comprising:

a cylindrical body having a first section and a second section in which the cylindrical body is hingedly secured around an exterior surface of the tubing;

roller bearing means positioned on and extending outwardly from and in generally axial direction along the cylindrical body for reducing friction between the tubing and the wall surface generated upon contact between the tubing friction reducer and the wall surface; and retaining means for removably securing the roller bearing means to the cylindrical body.

13. The friction reducer of claim 12 wherein the roller bearings are arranged in a plurality of axially spaced rows along an outer surface of the cylindrical body.

14. The friction reducer of claim 12 wherein the roller bearings are arranged in a plurality of circumferentially spaced rows along an outer surface of the cylindrical body.

15. The friction reducer of claim 13 wherein the means for securing the roller bearings is a plurality of collapsible springs fastened along a surface of the cylindrical body.

16. The friction reducer of claim 15 wherein the collapsible springs have a first end slidably retained by the cylindrical body and a second end slidably retained by the cylindrical body.

17. The friction reducer of claim 16 wherein the cylindrical body includes grooves for slidable engagement of the first and second ends of the collapsible springs, said grooves preventing lateral movement of the spring.

18. A tubing friction reducer adapted for mounting on a tubing pipe for use inside a bore in an underground formation or in a tubular casing installed in such formation, the robing having an outside diameter normally spaced from an inside wall surface of the bore or casing, the tubing friction reducer comprising:

a cylindrical body having a first section and a second section in which the cylindrical body is hingedly secured around an exterior surface of the tubing;

roller bearing means extending outwardly from the cylindrical body for reducing friction between the tubing and the wall surface created upon contact between the tubing friction reducer and the wall surface; and a plurality of collapsible springs for securing the roller bearing means to the cylindrical body.

19. The friction reducer of claim 18 wherein the collapsible springs have a first end slidably retained by the cylindrical body and a second end slidably retained by the cylindrical body.

20. The friction reducer of claim 19 wherein the cylindrical body includes grooves for slidable engagement of the first and second ends of the collapsible springs.

* * * * *

UNITED STATES PATENT AND TRADEMARK OFFICE

CERTIFICATE OF CORRECTION

PATENT NO. : 5,692,563

DATED : December 2, 1997

INVENTOR(S) : R. Ernst Krueger; N. Bruce Moore

It is certified that error appears in the above-indentified patent and that said Letters Patent is hereby corrected as shown below:

Abstract, line 2, replace "includes" with -- comprises --.
Column 12, line 10, change "$F_t$" to $-F_T$--.
Column 14, line 24, replace "beatings" with -- bearings --.
Column 16, line 9, replace "robing" with -- tubing --.

Signed and Sealed this

Third Day of November, 1998

*Attest:*

*Attesting Officer*

BRUCE LEHMAN

*Commissioner of Patents and Trademarks*